US005762375A

United States Patent [19]

Kogutt et al.

[11] Patent Number: 5,762,375

[45] Date of Patent: Jun. 9, 1998

[54] INLAID PORTFOLIO AND METHOD OF MAKING SAME

[75] Inventors: Randy A. Kogutt; Michael A. Kogutt, both of Dallas, Tex.

[73] Assignee: Dart Manufacturing Company, Dallas, Tex.

[21] Appl. No.: 784,707

[22] Filed: Jan. 16, 1997

[51] Int. Cl.[6] ..... B42D 3/00

[52] U.S. Cl. ..... 281/37; 281/29

[58] Field of Search ..... 281/29, 37, 51; 402/73, 74; 283/64

[56] References Cited

U.S. PATENT DOCUMENTS

| | | | |
|---|---|---|---|
| D. 223,644 | 5/1972 | Croon | D87/1 |
| D. 240,726 | 7/1976 | Harris | D19/33 |
| D. 241,381 | 9/1976 | Garnier | D87/3 A |
| D. 282,856 | 3/1986 | Daly | D19/33 |
| D. 319,729 | 9/1991 | Kogutt | D3/56 |
| D. 333,485 | 2/1993 | Kogutt | D19/32 |
| 2,639,168 | 5/1953 | Coppock | 281/37 X |
| 4,847,798 | 7/1989 | Kurashima | 364/708 |
| 4,991,767 | 2/1991 | Wyant | 281/29 X |
| 5,020,828 | 6/1991 | Moor | 281/29 |
| 5,662,447 | 9/1997 | Tsai | 281/29 X |

*Primary Examiner*—Willmon Fridie, Jr.

*Attorney, Agent, or Firm*—Akin, Gump, Strauss, Hauer & Feld, L.L.P.

[57] ABSTRACT

A portfolio or desk folder is formed from a flexible leather or synthetic leather cover member forming front and back covers, two generally rectangular stiffening elements, an interior liner and a flap forming a pocket. The cover member, liner and flap are bonded and/or sewn together around the periphery of the portfolio to secure the stiffening members spaced apart from each other with a spine formed therebetween. A generally rectangular window is formed in the front cover and a fabric inlay is secured to the cover member around the periphery of the window. The inlay preferably includes a multi-color image formed thereon by transferring the image from an image source to a transfer sheet by way of a multi-color photocopier and transferring the image from the transfer sheet to the inlay prior to insertion of the inlay in the window. Portfolios with ornamental images of a wide variety may be fabricated.

20 Claims, 2 Drawing Sheets

INLAID PORTFOLIO AND METHOD OF MAKING SAME

FIELD OF THE INVENTION

The present invention pertains to a portfolio or desk folder having an ornamental inlay on the cover and a method of manufacturing such a portfolio or folder.

BACKGROUND

Portfolios or desk folders for business papers, note pads and other business accessory items are widely used by persons in conducting day-to-day business as well as personal affairs. Portfolios with ornamental features such as a popular trademark, symbol or other graphic image associated with a business entity, for example, are popular promotional, personal point of recognition and gift items.

Portfolios or desk folders of the general type described herein are typically fabricated of a soft, durable material such as leather or a synthetic leatherlike material. The application of ornamental designs or pictorial scenes on the cover or other portions of such articles is somewhat constrained by the ability to provide a suitable ornamental or pictorial feature on the surface of leather or leatherlike synthetic materials. However, in accordance with the present invention a unique portfolio or desk folder is provided which includes an ornamental inlay and which is fabricated in such a way that an inexpensive yet aesthetically appealing portfolio is provided and which may be adapted to provide a wide variety of ornamental features or graphic or pictorial scenes thereon.

SUMMARY OF THE INVENTION

The present invention provides an improved portfolio or desk folder including an inlay which may be provided on the exterior or interior of the portfolio cover or liner and which may be provided with one of a wide variety of ornamental or pictorial images on the inlay. The present invention also provides a method of making a portfolio or desk folder having an inlay therefor and which inlay may be characterized by one of virtually an infinite variety of multi-color images applied thereto.

In accordance with one important aspect of the present invention a business portfolio or desk folder is characterized by front and back cover parts which are integrally joined at a spine portion and further comprise a flexible cover member which may be made of a single piece of flexible, soft and durable material and includes a window, preferably formed in the front cover part. The portfolio also includes an inner liner for the front and back cover parts and the liner is secured to the cover parts to enclose and support stiffeners for the front and back cover parts. An inlay or so called window pane of a fabric or similar material is provided to which an ornamental design or image is applied by a thermal transfer process and the inlay is attached to the portfolio or folder so that it is viewable through the window. The window may be provided in one or the other or both of the cover parts or, if desired, in the liner.

The present invention also provides an improved and aesthetically pleasing portfolio or desk folder wherein a multi-color image is transferred to a fabric inlay part or window pane which is then suitably secured in a window formed in a cover part for the portfolio and the portfolio is then assembled in such a way as to retain the window pane in a desired position on the portfolio in an improved manner.

In the manufacture of a portfolio or desk folder of the invention a flexible sheet-like cover member is formed by die cutting the cover member out of a sheet of flexible material and a window is simultaneously cut in the cover member. A window pane is formed of a heat resistant fabric, such as woven polyester, an image to be applied to the window pane is chosen and this image is transferred by way of a multi-color photocopier to a sheet of transfer paper. The transfer paper is then applied to the inlay or window pane and the image is thermally transferred to the window pane. The window pane may then be conveniently attached to the cover member at the window by sewing the window pane to the cover at the window, preferably around the periphery thereof. Separate front and back cover stiffeners and a liner are then assembled to the cover by bonding the liner to the cover at the periphery thereof with the stiffeners trapped therebetween. The front and back covers are then sewn around their perimeter to the liner and, preferably, the stiffener so as to form a strong, durable and aesthetically pleasing portfolio.

Those skilled in the art will further appreciate the above-mentioned advantages and features of the invention together with other important aspects thereof upon reading the detailed description which follows in conjunction with the drawing.

DESCRIPTION OF THE PREFERRED EMBODIMENTS

Figure 1:
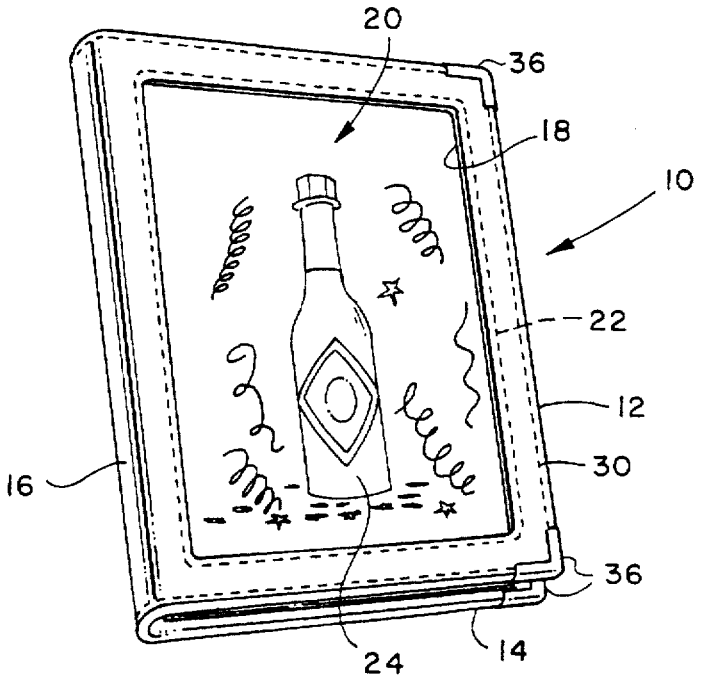
FIG. 1 is a perspective view of a portfolio in accordance with the present invention in the closed position of the front and back covers and showing an ornamental inlay on the front cover.

In the description which follows like elements are marked throughout the specification and drawing with the same reference numerals, respectively. The drawing figures are not necessarily to scale and certain features may be shown in generalized or somewhat schematic form in the interest of clarity and conciseness.

Figure 2:
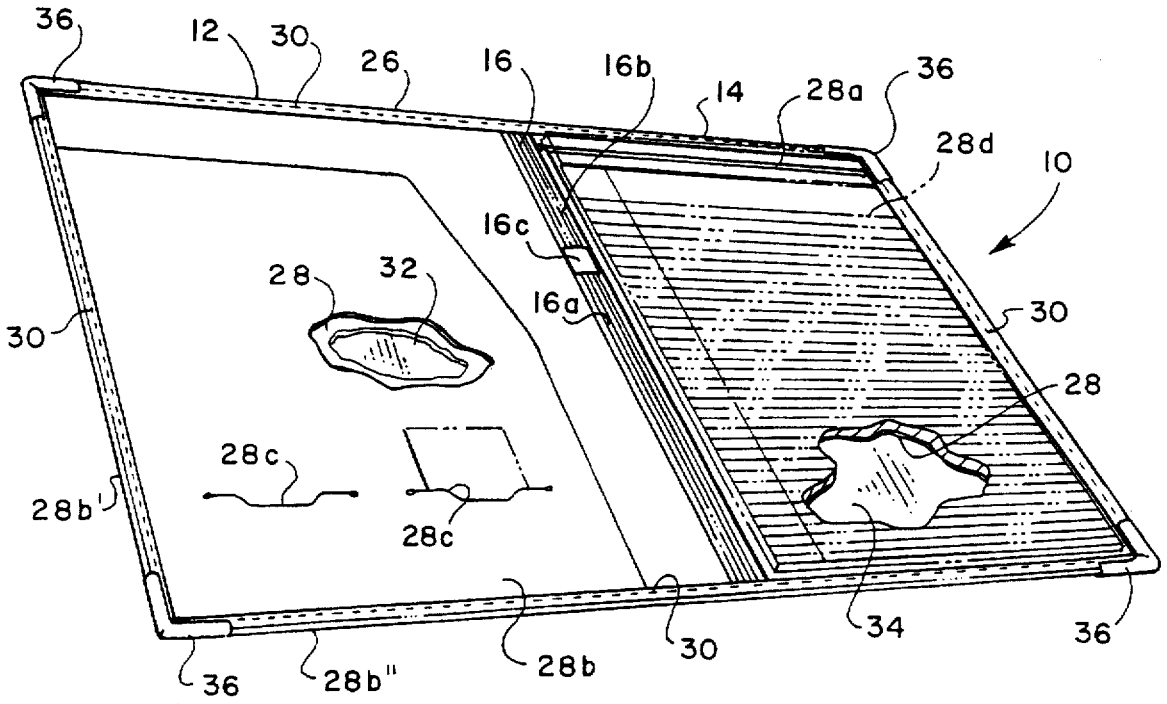
FIG. 2 is a perspective view of the portfolio shown in FIG. 1 in an open position.

Referring to FIGS. 1 and 2, there is illustrated a portfolio or desk folder in accordance with the present invention and generally designated by the numeral 10. The portfolio 10 is characterized by front and back cover parts 12 and 14 which are hinged together at a spine portion 16, not unlike the front and back covers of a hard-bound book. The front and back covers may be moved between a folded or closed position as shown in FIG. 1, and an open position as shown in FIG. 2. As shown in FIG. 1, the front cover part 12 is provided with a generally rectangular window 18 formed by removing the material forming the cover part 12 in a selected geometric pattern such as a rectangle, as shown. The window 18 is adapted to show an inlay, generally designated by the numeral 20, which is suitably secured to the portfolio 10, including the cover part 12 in a manner to be described in further detail herein. The inlay 20 is preferably formed of a piece of fabric which may be secured to the front cover part 12 by conventional stitching 22 around the periphery of the window 18, as indicated in FIG. 1. Other means for securing the inlay or window pane 20 to the cover part 12 may also be provided, including thermal or chemical bonding or other forms of adhesion. Typically, the inlay 20 is formed of a piece of durable fabric to which has been applied ornamental indicia or a pictorial image 24, which image may comprise a wide variety of subject matter including anything from an image of a product of commerce to a pastoral scene. Manufacturers of industrial or consumer products, for example, may advantageously provide portfolios, such as the portfolio 10, with an image of their product or the company trademark or logo imprinted on the window pane or inlay 20 in accordance with the invention. Virtually any two-dimensional image may be applied to the inlay 20 in accordance with the invention and the inlay then applied to or secured to the portfolio 10, also in accordance with the invention.

The portfolio 10 is preferably characterized by a generally rectangular cover member 26, FIG. 2, forming the cover parts 12 and 14 and the spine 16 and an inner liner 28 formed of a single piece of flexible material having approximately the same rectangular shape as the cover member 26 and suitably secured thereto all around the periphery of the portfolio 10, such as at stitching 30. The stitching 30 may be ornamental as well as functional and is operable to aid in reinforcing the portfolio and determining the location of two, generally rectangular stiffener members 32 and 34 portions of which are shown through broken away portions of the liner 28 in FIG. 2. The stiffener members 32 and 34 are generally rectangular plate-like members of durable fiberboard, expanded plastic foam sheet, cardboard or so-called chipboard, which are placed between the cover member 26 and the liner 28 and are also secured in place preferably by chemical, thermal, radio frequency, ultrasonic or other forms of welding of the liner to the cover member around the periphery thereof, followed by further securing the cover member to the liner with the stitching 30.

The spine 16, for example, may be suitably reinforced by bonding the liner 28 to the cover member 26 along the striations **16*a* and 16*b*, for example. An integral loop of liner material 16*c* may be formed to serve as a pen or pencil holder. The liner 28 may have a suitable slot 28*a*, or other means thereon for retaining suitable articles inside the portfolio such as a tablet 28*d*, for example. A flap formed of a third layer of material 28*b* is bonded to the liner 28 along and adjacent to the side and bottom edges 28*b*' and 28*b*" to form a pocket between the liner and the flap. Suitable slots 28*c* are formed in the flap 28*b* for retaining business cards, etc., therein. The portfolio 10 may also be provided with ornamental and protective metal corner members 36 suitably attached by crimping, for example, to the top and bottom corners of the front cover part 12 and the back cover part 14, as shown in FIGS. 1 and 2**.

The dimensions of a portfolio 10 in accordance with the present invention may, typically, be in the range of about 9.5 by 12.5 inches, for example, in the folded position shown in FIG. 1, thereby making the overall length of the portfolio, in the open position, to be in the range of about 19 inches. The window 18 is typically rectangular in shape and may be about 7.6 inches wide by 10.2 inches in length or height. The slot **28*a* and flap 28*b* are exemplary and other slots or means may be provided for retaining items, such as notebooks, checkbooks, tablets, calculators, business cards and other articles secured within the portfolio 10. The window 18 may be of a different size and geometry from that shown and other window panes may be provided in the back cover part 14 or the interior of the portfolio 10, such as in the liner 28 or flap 28*b*. However, the location of the window 18 on the exterior of the front cover part 12** is preferred.

A typical material used for fabricating the cover part 26 is, for example, leather or a fabric-backed or otherwise reinforced vinyl sheet of about 0.050 inches in thickness. The liner 28 and flap **28*b* may be formed of 0.015 inches thick vinyl film or the like. The window pane 20 is preferably formed of a heat resistant fabric, such as a 600 denier, woven, heat resistant polyester and the like. Other materials may be used for the window pane or inlay 20, the liner 28, flap 28*b* and the cover member 26 as will be appreciated by those skilled in the art. The cover member 26, the liner 28 and flap 28*b* are preferably secured to each other by conventional adhesive and bonding techniques as will be described further herein and the portfolio 10 is assembled by stitching at 22 and 30 using conventional equipment for stitching articles of manufacture made from soft flexible materials, such as leather or so called synthetic vinyl leather. The stiffeners 32 and 34 may be formed of chipboard having a thickness of about 0.08 inches. The width of the peripheral edge or border of the cover member 26, whereby the cover member is larger than the liner 28 to permit folding the edge over and securing same to the liner 28 and to the cover member itself by the stitching 30, may be appropriate for the particular size of portfolio fabricated. A width of a peripheral border or hem 31, FIG. 2**, of about 0.40 inches is indicated to be suitable for the dimensions given hereinabove.

Figure 3:
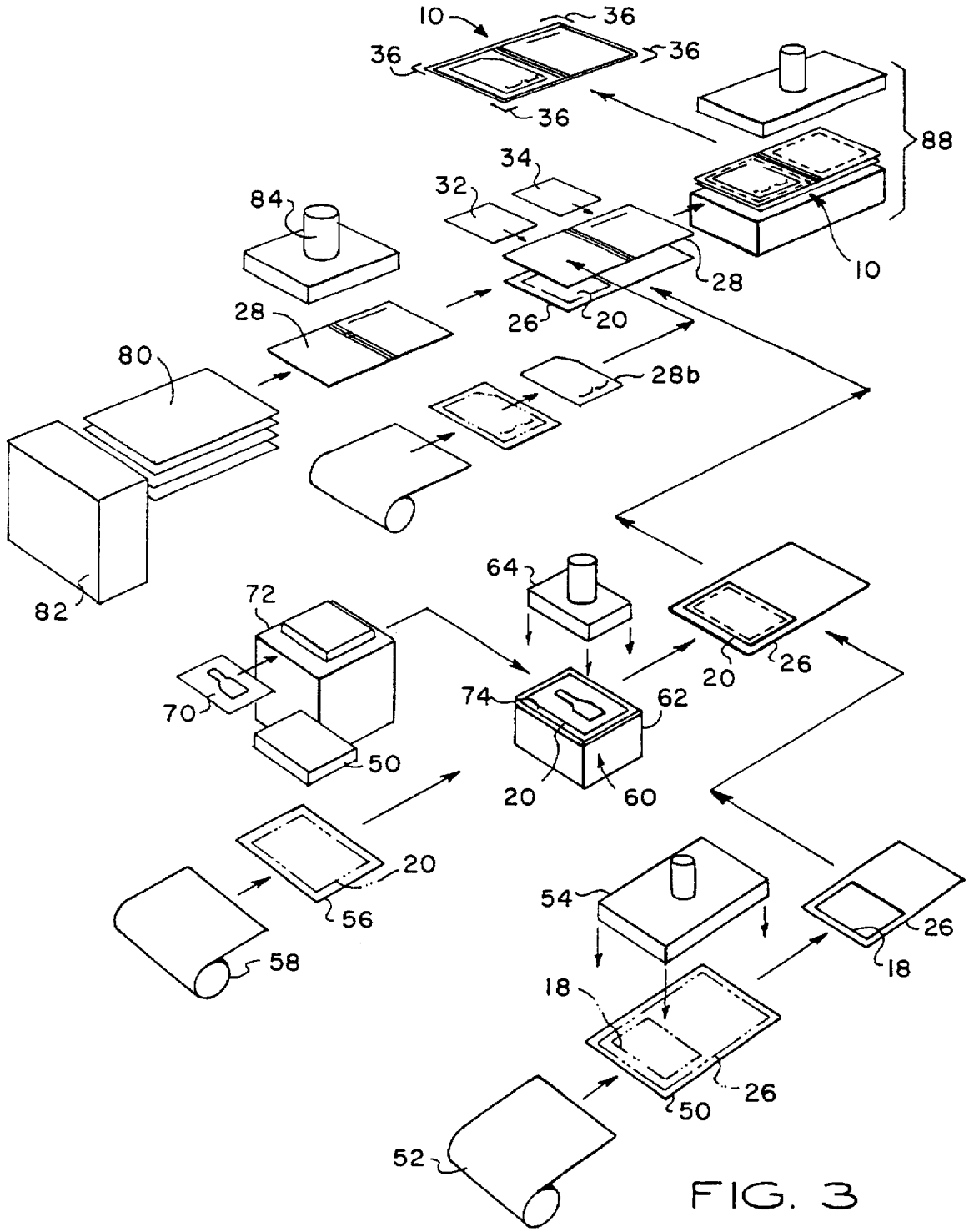
FIG. 3 is a schematic diagram illustrating certain steps in the manufacture of the portfolio shown in FIGS. 1 and 2.

Referring now to FIG. 3, a preferred method in accordance with the invention for manufacturing a portfolio 10 with an inlay 20 is at least partially illustrated in somewhat schematic form and will be described as follows. Cover members 26 may be fabricated by cutting suitable sheets 50 from a roll of material 52. The cover member 26 and the window 18 may be formed simultaneously by die cutting a sheet 50 using suitable die cutting apparatus 54 to provide a cover member 26, as illustrated. The window pane or inlay 20 may also be fabricated by providing suitable sheets 56 of window pane material from a roll 58 thereof and die cutting the window pane to a predetermined size using suitable die cutting apparatus 58. After forming the window pane 20 it is preferably placed on a thermal transfer apparatus 60 including a transfer apparatus bed 62 and a movable platen or cover 64. The transfer apparatus 60, 62, 64 may be of a type manufactured by INSTA as their model 826. Image transfers may be provided for application to the window pane 20 by selecting a suitable two-dimensional image such as photoprint 70 or a similar article, placing this article on a suitable multi-color photocopier 72, FIG. 3, such as a so called color laser copier of a type manufactured by Canon as their model 500 Color Laser Copier. The image from the article 70 is thus transferred to a transfer sheet 74 in the photocopier 72, which sheet is then placed on and contiguous with the window pane or inlay 20 prior to operating the transfer apparatus 60 to thermally transfer inks on the transfer sheet to the window pane or inlay 20. The transfer sheets 74 may be of a type commercially available, such as a type made by Airwaves as their One-Step Elite color laser transfer paper. The image produced on a transfer sheet may be required to be inverted or a mirror image if alpha numeric text is to be readable on the final inlay image, for example. A finished window pane or inlay 20 is shown in FIG. 3 inverted and laying on a cover member 26 and covering the window 18.

The process of providing a suitable image on a transfer sheet 74 includes the further steps of trimming the image field or peripheral nonimage areas from the transfer paper prior to application to the image portion of the sheet surface of the window pane or inlay 20 on the transfer apparatus 60. Still further, determining the specific position of the transfer sheet 74 on the inlay or window pane 20 must be properly carried out.

Once the inlay 20 has been provided with a multi-color image thereon and positioned in the window 18 of the cover member 26 the inlay may be adhered to the cover member with a suitable adhesive disposed at the corners of the inlay, for example, or in any position thereon suitable to adequately retain the inlay in the window 18. This step in the preparation of the cover member 26 is followed by sewing the inlay or window pane 20 to the cover member with stitching 22.

Concomitant with preparation of the cover member 26 as described above, the liner 28 may be prepared by generating suitable numbers of sheets 80 of liner material with a conventional sheeting apparatus 82 such as a type manufactured by Colbus Sheeter as their model 981290. Single sheets 80 may then be die cut to provide the liner 28 using a suitable die cutting apparatus 84. The flap **28*b* may be cut from a roll or from sheets produced by the apparatus 82 also, and then die cut to the desired shape. Alternatively, all die cut parts of the portfolio 10** may be precut in desired quantities using the same die cutting apparatus, and using the appropriate die for each part, and the parts then stored for use when portfolios are to be assembled.

After forming the liner 28 and flap **28*b* and preparing the cover member 26 as described above, the cover member is placed on a suitable surface such that the stiffener members 32 and 34 may be properly positioned on the cover member, the liner 28 is then placed over the cover member and the stiffeners 32 and 34, followed by placing the flap 28*b* over the liner and then sealing the flap and liner to the cover member using a conventional apparatus 88 which thermally or mechanically welds the liner to the cover member around the periphery of each. One example of such apparatus is a model F15-30 manufactured by Thermatron. Stitching 30 is then applied around the periphery of the portfolio 10 to sew the cover member 26 to itself, to the liner 28 and flap 28*b* and to the stiffener members 32 and 34. Lastly, the reinforcement or corner members 36 may be suitably crimped to the respective corners of the portfolio 10 in the positions shown in FIGS. 1 and 2**.

Those skilled in the art will recognize that a unique method of fabricating an ornamental or inlaid portfolio or desk folder may be carried out in accordance with the invention using conventional manufacturing equipment, image transfer equipment and materials while providing a functional and aesthetically pleasing article of manufacture which may have two-dimensional images of a virtually infinite variety applied thereon. The selection of a material for the window pane or inlay 20 may vary. A woven polyester of the type described above is advantageous and provides an aesthetically pleasing texture to the inlay for a wide variety of images printed thereon. The above-mentioned types of transfer paper also apply a somewhat protective coating to the image transferred to the inlay or window pane.

Although a preferred embodiment of a portfolio or desk folder and a method of making same have been described in detail hereinabove, those skilled in the art will recognize that various substitutions and modifications may be made to the invention without departing from the scope and spirit of the appended claims.

What is claimed is:

1. A method of making a foldable portfolio comprising a generally rectangular exterior cover member and an interior liner secured to each other generally around the periphery of said portfolio, a window formed in at least one of said cover member and said liner and an inlay having a printed image thereon disposed in said window and secured to said portfolio to provide ornamental indicia on said portfolio, said method comprising the steps of:

forming said cover member;

forming said liner;

forming a window in one of said cover member and said liner;

forming said inlay from a sheet of flexible material;

providing an image on a transfer sheet for transferring said image to said inlay;

transferring said image from said transfer sheet to said inlay;

placing said inlay at said window with said image substantially within said window and securing said inlay to one of said cover member and said liner; and securing said cover member to said liner.

2. The method set forth in claim 1 including the step of:

placing at least one stiffening part between said cover member and said liner.

3. The method set forth in claim 2 wherein:

the step of placing said stiffening part includes providing separate stiffening parts for a front cover portion and a back cover portion of said portfolio wherein at least one of said stiffening parts is positioned in supportive relationship to said inlay.

4. The method set forth in claim 1 including the step of:

securing said cover member to said liner by bonding said cover member to said liner around the periphery thereof.

5. The method set forth in claim 4 including the step of:

sewing said cover member to said liner around the periphery thereof.

6. The method set forth in claim 1 including the step of:

sewing said inlay to said one of said cover member and said liner around the periphery of said window.

7. The method set forth in claim 1 including the step of:

providing a photo-copier apparatus, placing an article containing said image on said copier apparatus and transferring said image from said article containing said image to said transfer sheet; and transferring said image from said transfer sheet to said inlay by at least one of pressing and heating said transfer sheet against said inlay.

8. The method set forth in claim 7 including the step of:

providing said inlay as a heat resistant fabric.

9. The method set forth in claim 8 including the step of:

providing said inlay of heat resistant woven polyester.

10. The method set forth in claim 1 including the step of:

providing said cover member formed of a flexible polymer material having a thickness not less than about 0.050 inches and providing said liner as a sheet of polymer material having a thickness not less than about 0.15 inches.

11. The method set forth in claim 1 including the step of:

securing a flap to said liner along at least two edges thereof.

12. A portfolio manufactured by the method set forth in claim 1.

13. A portfolio comprising:

a cover member comprising a sheet of flexible material forming a front cover and a back cover and having a generally rectangular window therein;

a pair of generally rectangular spaced apart stiffening members dimensioned to be less in height and width than the height and width of said front cover and said back cover, respectively;

a flexible liner member having a generally rectangular shape and adapted to be secured to said cover member with said stiffening members disposed between said liner and said cover member and spaced apart from each other on each side of a spine formed between said front cover and said back cover;

an inlay sheet having an image formed thereon by transferring said image from a source of said image to a transfer sheet and from said transfer sheet to said inlay sheet; and said portfolio being formed by positioning said inlay sheet in said window and supported by one of said stiffening members and securing said liner to said cover member around the periphery of said portfolio to form said front cover and said back cover with said image showing through said window.

14. The portfolio set forth in claim 13 wherein:

said liner is bonded to said cover member at a substantially central position on said cover member between opposite side edges thereof to form said spine.

15. The portfolio set forth in claim 13 wherein:

said image on said inlay sheet is formed by transferring said image from said source to said transfer sheet by photocopying said image onto said transfer sheet.

16. The portfolio set forth in claim 15 wherein:

said image is transferred from said transfer sheet by heating and pressing said transfer sheet against said inlay sheet.

17. The portfolio set forth in claim 13 wherein:

said cover member is formed of reinforced vinyl having a thickness of about 0.050 inches.

18. The portfolio set forth in claim 17 wherein:

said liner is formed of vinyl having a thickness of about 0.015 inches.

19. The portfolio set forth in claim 13 wherein:

said inlay sheet is formed of a heat resistant woven polyester.

20. The portfolio set forth in claim 13 including:

a generally sheetlike flap secured to said liner along two edges thereof to form a pocket.

* * * * *